US008047794B2

(12) United States Patent
Wang

(10) Patent No.: US 8,047,794 B2
(45) Date of Patent: Nov. 1, 2011

(54) FAST-POSITIONING DEVICE FOR ASSEMBLING BLADE BRACKETS TO A MOTOR HOUSING OF A CEILING FAN

(75) Inventor: Cliff Wang, Tanzih Township, Taichung County (TW)

(73) Assignee: Air Cool Industrial Co., Ltd., Taichung County (TW)

( * ) Notice: Subject to any disclaimer, the term of this patent is extended or adjusted under 35 U.S.C. 154(b) by 1159 days.

(21) Appl. No.: 11/770,794

(22) Filed: Jun. 29, 2007

(65) Prior Publication Data

US 2009/0004016 A1 Jan. 1, 2009

(51) Int. Cl.
*F04D 29/34* (2006.01)

(52) U.S. Cl. ..... 416/210 R; 416/219 A

(58) Field of Classification Search ..... 416/210 R, 416/219 A, 238

See application file for complete search history.

(56) References Cited

U.S. PATENT DOCUMENTS

| | | | | |
|---|---|---|---|---|
| 5,873,701 | A * | 2/1999 | Shiu | 416/205 |
| 5,927,945 | A * | 7/1999 | Chen | 416/5 |
| 5,951,197 | A * | 9/1999 | Wu | 403/315 |
| 6,095,753 | A * | 8/2000 | Hsu | 416/210 R |
| 6,210,117 | B1 * | 4/2001 | Bucher et al. | 416/210 R |
| 6,382,918 | B1 * | 5/2002 | Tang | 416/210 R |
| 6,676,376 | B2 * | 1/2004 | Kerr, Jr. | 416/142 |
| 6,699,014 | B1 * | 3/2004 | Lam et al. | 416/5 |

* cited by examiner

*Primary Examiner* — Nathaniel Wiehe
(74) *Attorney, Agent, or Firm* — Ming Chow; Sinorica, LLC

(57) ABSTRACT

The invention relates to a fast-positioning device for assembling blade brackets to a motor housing of a ceiling fan. The motor housing has its bottom provided with plural locations located around its circumference, which are respectively extended downward with at least two restricting plates having a long side aligned as a beam radiated from the center of the motor housing. Each location of the restricting plates is to be connected with a blade bracket, which has a connecting portion extended with at least one positioning projection for being moved horizontally to engage with the restricting plates. As good vision is kept during installation, the blade brackets can be easily assembled on the motor housing and the relative locations to be positioned are in a line.

4 Claims, 4 Drawing Sheets

FAST-POSITIONING DEVICE FOR ASSEMBLING BLADE BRACKETS TO A MOTOR HOUSING OF A CEILING FAN

BACKGROUND OF THE INVENTION

1. Field of the invention

This invention relates to a ceiling fan, particularly to one having a fast-positioning device for assembling blade brackets to its motor housing.

2. Description of the Prior Art

Commonly, screws and threaded holes are the typical devices used to keep blade brackets assembled with a conventional ceiling fan motor. As disclosed in U.S. Pat. No. 6,210,117, "DEVICE FOR CONNECTING A FAN BLADE TO A ROTOR OF A CEILING FAN MOTOR", the housing of a conventional ceiling fan motor is provided with plural fixing holes bored around its circumference, equidistantly spaced apart. Two sides of the fixing hole are respectively bored with a screw hole. The blade bracket is provided with a pin and two through holes respectively corresponding to the fixing hole and the screw holes of the motor housing, so that a pin can be inserted in the fixing hole, and the screw holes and the through holes can be deadly connected by screws, enabling the blade bracket stably assembled under the motor housing. In assembly, the motor is first installed below the ceiling and then, the pin of the blade bracket is aimed at and inserted in the fixing hole to achieve a primary position. Next, pivoting on the pin, the blade bracket has to be slightly swung so as to keep the through holes faced exactly to the screw holes for positioning the screws. However, as the blade bracket is vertically assembled upward, the fixing hole is to be covered up while raising the blade bracket to the motor housing closely, making a difficult and an inefficient installation as a worker has to try to locate the fixing hole for the pin.

SUMMARY OF THE INVENTION

The objective of this invention is to offer a fast-positioning device for assembling blade brackets to a motor housing of a ceiling fan.

The motor housing has its bottom provided with plural locations around its circumference, which are respectively extended downward with at least a pair of restricting plates having a long side arranged radially from the center of the motor housing. Each pair of the restricting plates is to be connected with a blade bracket provided with a connecting portion that is at least extended with one positioning projection for being moved horizontally to engage with the restricting plates. As good vision is kept during installation, the blade brackets can be easily assembled on the motor housing, enabling the engaging locations between the blade brackets and the motor housing exactly facing to each other.

BRIEF DESCRIPTION OF DRAWINGS

This invention is better understood by referring to the accompanying drawings, wherein.

DETAILED DESCRIPTION OF THE PREFERRED EMBODIMENT

Figure 1:
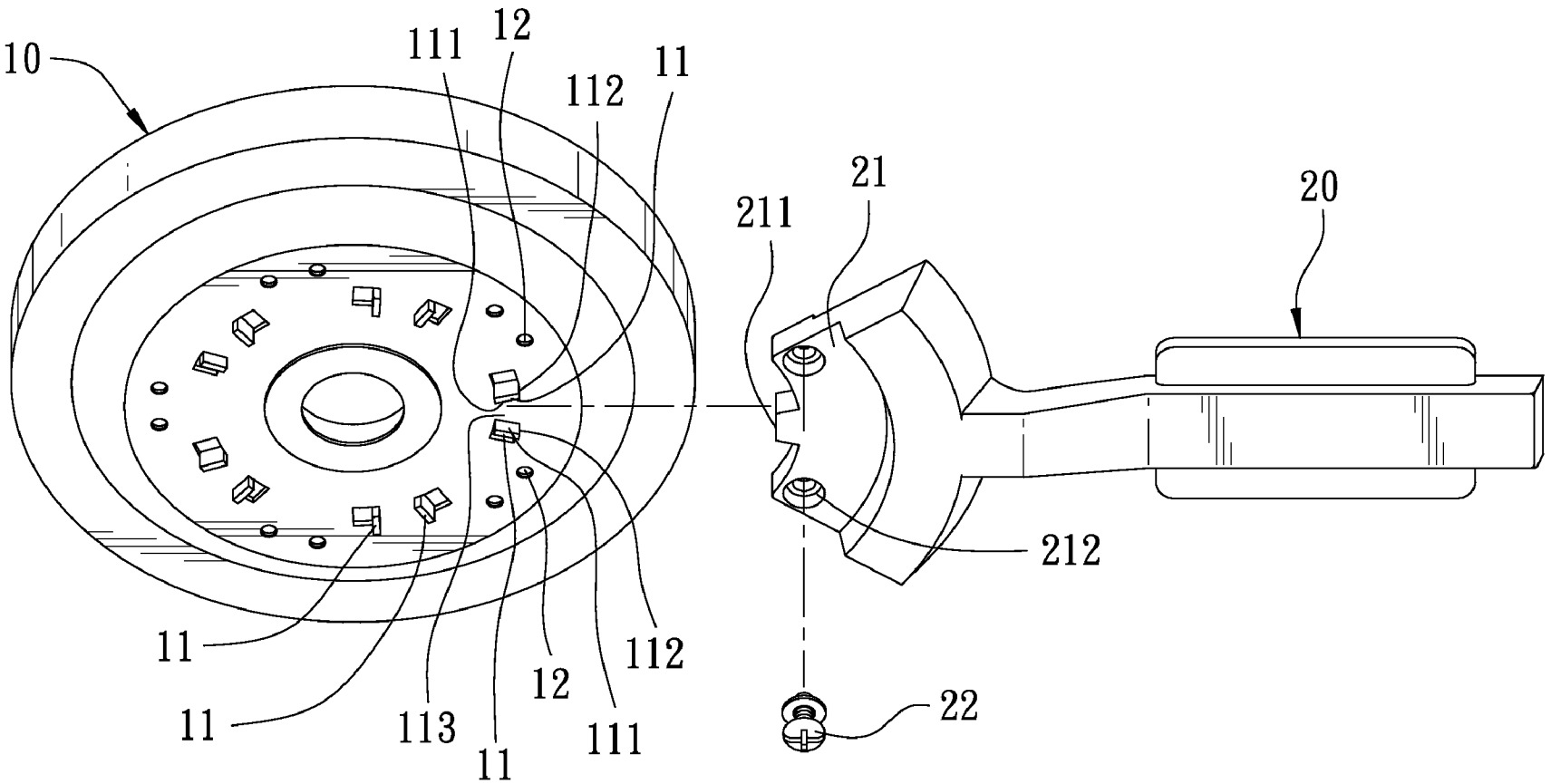
FIG. 1 is an exploded perspective view of a first preferred embodiment of a fast-positioning device for assembling blade brackets to a motor housing of a ceiling fan in the present invention.
Figure 2:
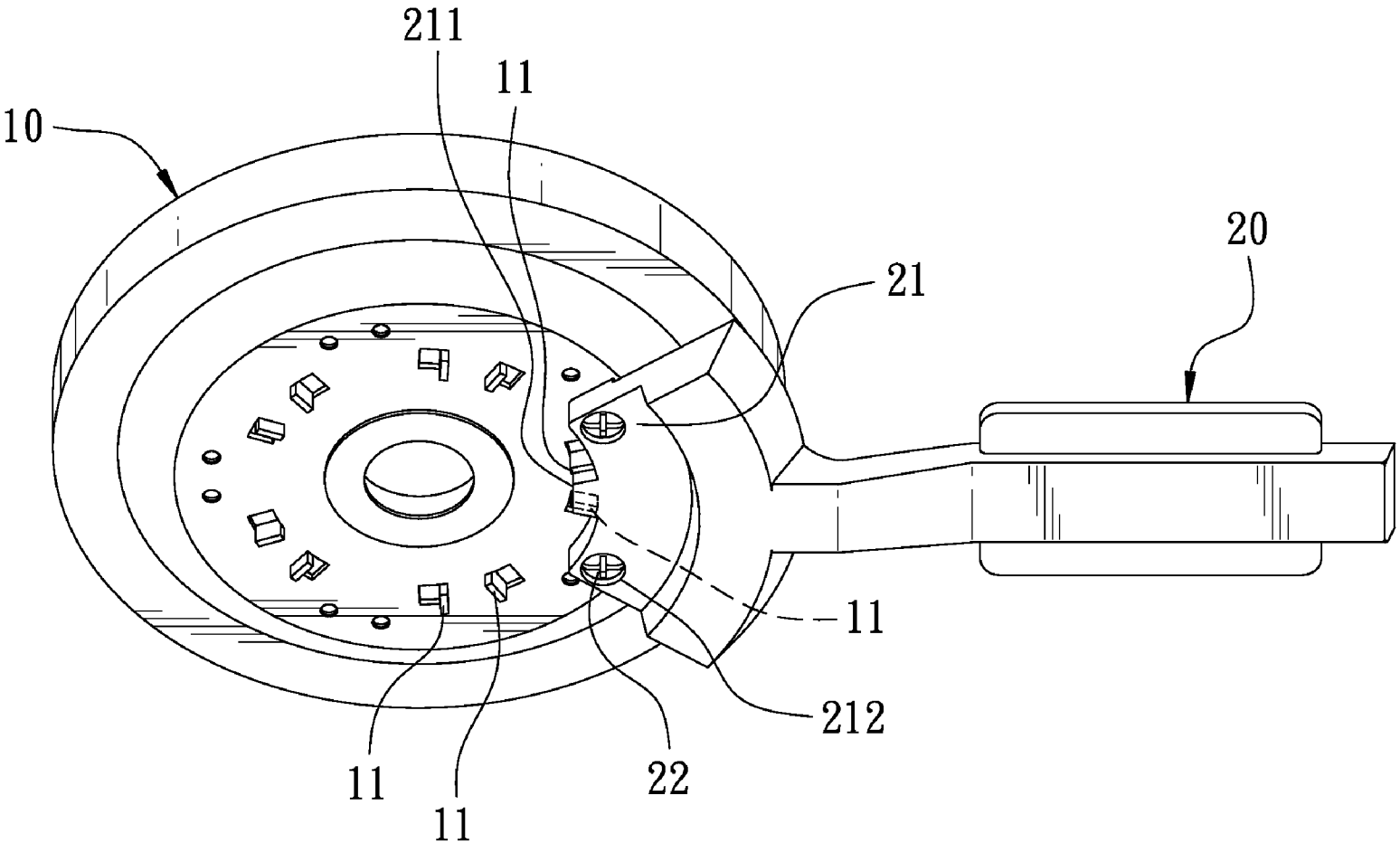
FIG. 2 is a perspective view of the first preferred embodiment of a fast-positioning device for assembling blade brackets to a motor housing of a ceiling fan in the present invention.
Figure 3:
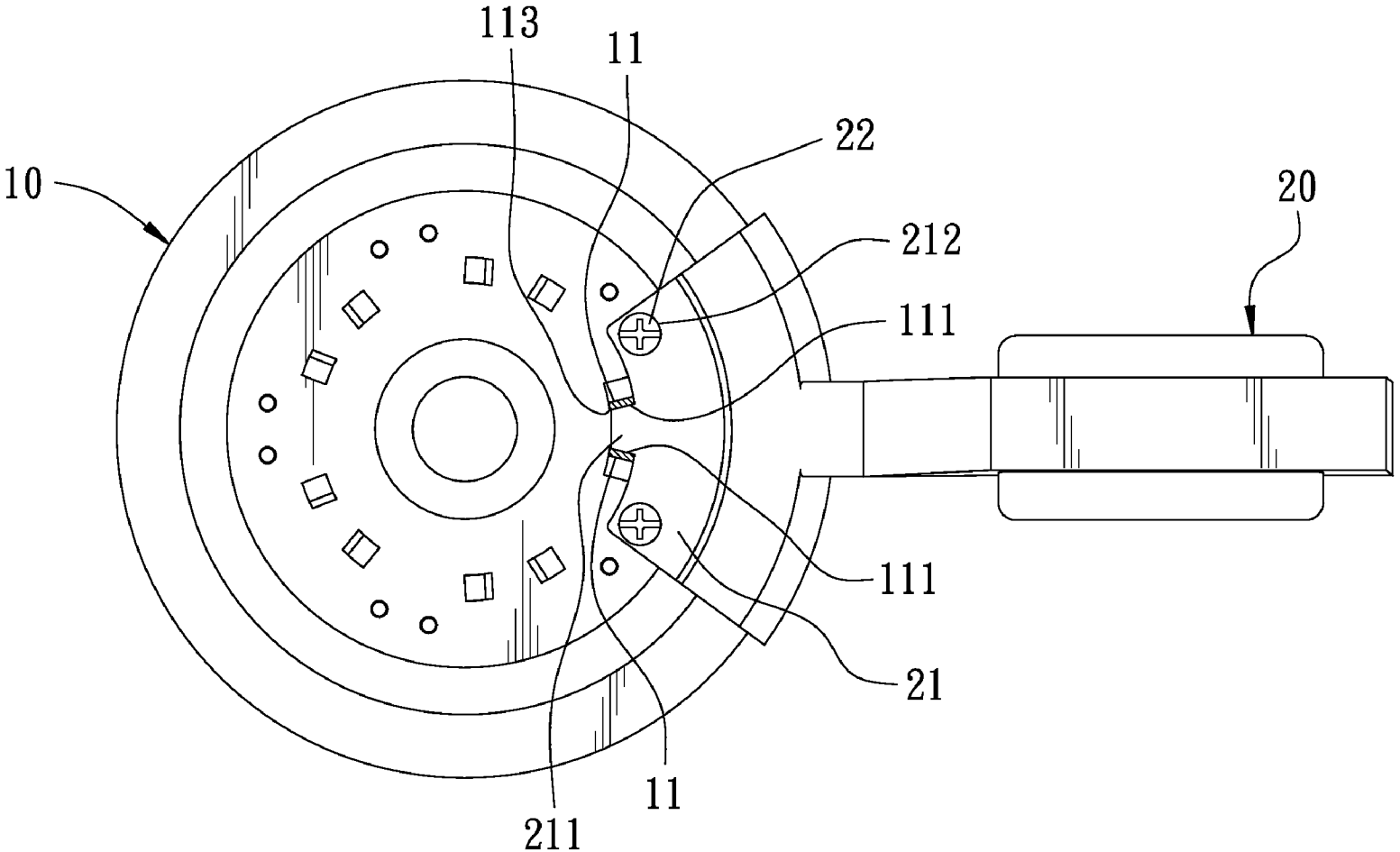
FIG. 3 is a bottom view of the first preferred embodiment of a fast-positioning device for assembling blade brackets to a motor housing of a ceiling fan in the present invention.

FIGS. 1~3 show a first preferred embodiment of a fast-positioning device for assembling blade brackets 20 to a motor housing 10 of a ceiling fan. The ceiling fan at least includes the motor housing 10 and the blade brackets 20.

The motor housing 10 has a round bottom, made of metal and provided with a pair of restricting plates 11 located at five certain locations around its circumference respectively, closer to its center, and equidistantly spaced apart. Each pair of the restricting plates 11 are integrally formed by pressing down from the bottom of the motor housing 10, separated with a certain distance. Each restricting plate 11 is provided with a long side 111 and a short side 112. The long sides 111 of the restricting plates 11 are arranged radially and orderly from the center of the motor housing 10, so that a restricting space 113 is formed between the long sides 111 of each pair of the restricting plates 11, shaped as a trapezoid. The motor housing 10 is also provided with a threaded hole 12 bored at two sides of each pair of the restricting plates 11. The blade bracket 20 is provided with a connecting portion 21 for connecting with the motor housing 10. Corresponding to the restricting space 113, the connecting portion 21 is provided with a positioning projection 211 extended from its center, which is shaped as the same trapezoid as the restricting space 113 is. Thus, the positioning projection 211 can be horizontally put in the restricting space 113 and confined by the long sides 111. In addition, the blade bracket 20 is also provided with a through hole 212 bored at two sides of the positioning projection 211 respectively for a screw 22 to pass through to engage with the threaded hole 12.

As shown in FIGS. 1~3, in assembling, the motor housing 10 is first fixed under the ceiling and then, the blade bracket 20 is moved toward the motor housing 10 horizontally to keep the positioning projection 211 fitted in the restricting space 113. By the time, the through holes 212 of the blade bracket 20 are positioned exactly toward the screw holes 12 of the motor housing 10, ready for the screwing elements 22 to pass through to engage with the threaded holes 12. So, the blade brackets 20 are easily and stably assembled on the motor housing 10. Moreover, it is to be noted that the installation is completely carried out under a good vision as the blade bracket 20 is moved toward the motor housing 10 horizontally to keep the positioning projection 211 fitted in the restricting space 113.

Figure 4:
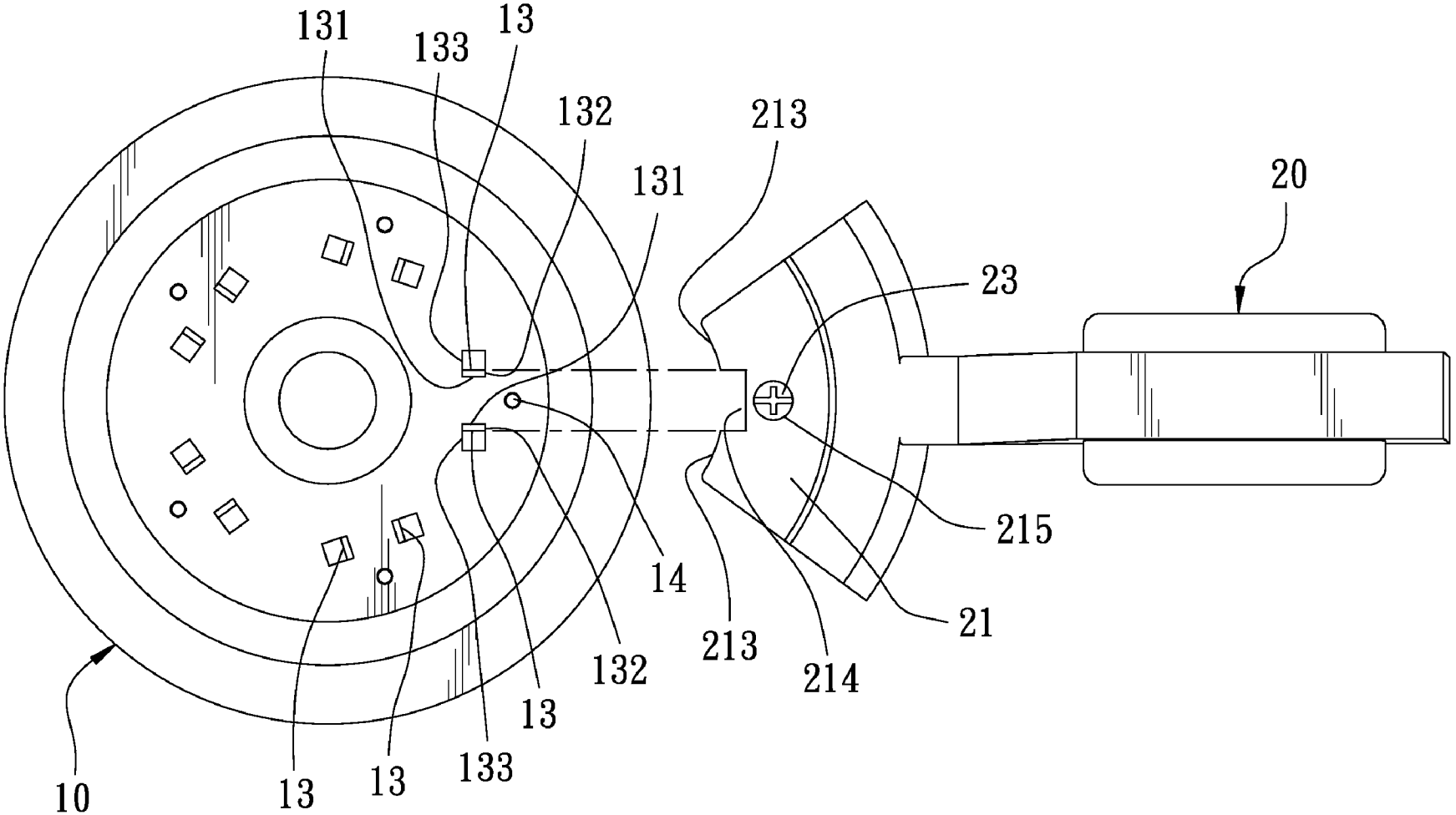
FIG. 4 is an exploded bottom view of a second preferred embodiment of a fast-positioning device for assembling blade brackets to a motor housing of a ceiling fan in the present invention.

As shown in FIG. 4, a second preferred embodiment of a fast-positioning device for assembling blade brackets 20 to a motor housing 10 of a ceiling fan has almost the same components as the first one does.

The motor housing 10 has a round bottom, made of metal and provided with a pair of restricting plates 13 located at five certain locations around its circumference respectively, closer to its center, and equidistantly spaced apart. Each pair of the restricting plates 11 are integrally formed by pressing down from the bottom of the motor housing 10, separated with a certain distance. Each restricting plate 13 is provided with a long side 131 and a short side 132. The space between the outer surfaces of the long sides 131 is formed as a restricting space 133. The motor housing 10 is in addition provided with a threaded hole 14 bored outside the center of the restricting plates 13. The long sides 131 of each pair of the restricting plates 13 are arranged radially from the center of the motor housing 10. The connecting portion 21 of the blade bracket 20 is provided with a restricting projection 213 extended from its two sides respectively, and a clamping groove 214 formed between the restricting projections 213. The restricting projections 213 of the blade bracket 20 can be moved toward the motor housing 10 horizontally, letting the pair of the restricting plates 13 fit in the clamping groove 214 quickly so that the blade bracket 20 may be assembled with the motor housing 10. Moreover, the connecting portion 21 is also provided with a through hole 215 bored at a location below the clamping groove 214 for corresponding to the threaded hole 14, for a screw 23 to pass through and engage with the threaded hole 14 to secure the blade bracket 20 tightly.

The advantages of the invention are described below as can be seen from the foresaid description.

In installation, a worker can put the positioning projection 211 of the blade bracket 20 into the restricting space 113 of the motor housing 10 under a clear vision as the blade bracket 20 is moved toward the motor housing 10 horizontally. And, the restricting plates 11 are formed integrally by pressing the bottom of the motor housing 10, able to upgrade manufacturing efficiency and lower cost.

While the preferred embodiment of the invention has been described above, it will be recognized and understood that various modifications may be made therein and the appended claims are intended to cover all such modifications that may fall within the spirit and scope of the invention.

What is claimed is:

1. A fast-positioning device for assembling blade brackets to a motor housing of a ceiling fan, a bottom of said motor housing assembled with a plurality of said blade brackets that are set around a circumference of said motor housing and equidistantly spaced apart, said blade brackets fixed with said motor housing by screws passing through corresponding through holes, said fast-positioning device characterized by:

said motor housing having its bottom provided with plural locations around its circumference and closer to its center, said locations equidistantly spaced apart, each of said locations pressed downward to form at least a pair of restricting plates, a long side of each said restricting plate respectively arranged radially and orderly from a center of said motor housing;

said blade bracket provided with a connecting portion for connecting with said motor housing, said connecting portion at least provided with a positioning projection extended from its front end to face to each pair of said restricting plates of said motor housing, said positioning projection horizontally moved toward to engage with said restricting plates without obstructing vision of a worker while installation, thus keeping said blade brackets quickly positioned on said motor housing with engaging locations of said blade bracket and said motor housing exactly facing to each other; and said motor housing is provided with a threaded hole bored at two sides of each said pair of said restricting plates respectively and said blade bracket is provided with a through hole bored at two sides of said positioning projection respectively for corresponding to said threaded hole, so that screws can be inserted through said through holes to engage with said threaded holes to keep said blade brackets installed stably under said motor housing.

2. The fast-positioning device for assembling blade brackets to a motor housing of a ceiling fan as claimed in claim 1, wherein said motor housing has a round bottom, made of metal and provided with a pair of restricting plates located at five certain locations around its circumference respectively and equidistantly spaced apart, said restricting plates integrally formed by pressing down from the bottom of said motor housing to be shaped rectangular and separated with a certain distance, each said restricting plate provided with a long side and a short side, said long sides of said pair of said restricting plates arranged radially and orderly from a center of said motor housing so that a restricting space is formed between said pair of said restricting plates, said connecting portion of said blade bracket provided with a positioning projection extended from its center to fit in said restricting space horizontally to easily secure said blade bracket with said pair of said restricting plates.

3. A fast-positioning device for assembling blade brackets to a motor housing of a ceiling fan, a bottom of said motor housing assembled with a plurality of said blade brackets that are set around a circumference of said motor housing and equidistantly spaced apart, said blade brackets fixed with said motor housing by screws passing through corresponding through holes, said fast-positioning device characterized by:

said motor housing having its bottom provided with plural locations around its circumference and closer to its center, said locations equidistantly spaced apart, each of said locations pressed downward to form at least a pair of restricting plates, a long side of each said restricting plate respectively arranged radially and orderly from a center of said motor housing;

said blade bracket provided with a connecting portion for connecting with said motor housing, said connecting portion at least provided with a positioning projection extended from its front end to face to each pair of said restricting plates of said motor housing, said positioning projection horizontally moved toward to engage with said restricting plates without obstructing vision of a worker while installation, thus keeping said blade brackets quickly positioned on said motor housing with engaging locations of said blade bracket and said motor housing exactly facing to each other; and said motor housing has a round bottom, made of metal and provided with a pair of restricting plates located at five certain locations around its circumference respectively and equidistantly spaced apart, each said pair of said restricting plates integrally formed by pressing down from a bottom of said motor housing to be shaped rectangular and separated with a certain distance, said restricting plate provided with a long side and a short side, said long sides arranged to extend radially from a center of said motor housing, a space formed as a restricting space between outer surfaces of said long sides, said connecting portion of said blade bracket provided with a restricting projection extended from its two sides respectively, and a clamping groove formed between said restricting projections, said positioning projections of said blade bracket moved horizontally to let each said pair of said restricting plates to fit in said clamping groove so as to keep said blade bracket positioned quickly on said motor housing.

4. The fast-positioning device for assembling blade brackets to a motor housing of a ceiling fan as claimed in claim 3, wherein said motor housing is provided with a threaded hole bored outside between each said pair of said restricting plates, and said blade bracket is provided with a through hole bored at a location below said clamping groove for corresponding to said threaded hole, so that screws can be inserted through said through holes to be fixed in said threaded holes to keep said blade brackets installed stably under said motor housing.

* * * * *